US005135355A

United States Patent [19]

Colley et al.

[11] Patent Number: 5,135,355

[45] Date of Patent: Aug. 4, 1992

[54] ROTOR WITH INTERNAL ELECTRICAL HEATING ELEMENT

[75] Inventors: Michael I. Colley, Birkenhead; John T. Griffith, Mold; Charles A. Rowbottom, Wirral, all of Great Britain

[73] Assignee: Electricity Association Technology Limited, London, United Kingdom

[21] Appl. No.: 740,441

[22] Filed: Aug. 5, 1991

[30] Foreign Application Priority Data

Aug. 7, 1990 [GB] United Kingdom ..... 9017312

[51] Int. Cl.[5] ..... F01D 5/08

[52] U.S. Cl. ..... 416/95; 222/146.5; 366/146; 366/147; 219/421; 219/523

[58] Field of Search ..... 416/95; 222/146.5, 190; 366/146, 147; 392/362; 219/421, 457, 523

[56] References Cited

U.S. PATENT DOCUMENTS

| | | | |
|---|---|---|---|
| 2,110,621 | 3/1938 | Cohen | 392/362 |
| 2,690,890 | 10/1954 | Weeks et al. | 416/95 |
| 3,109,913 | 11/1963 | Galajda, Jr. | 366/146 |
| 4,936,688 | 6/1990 | Cornell | 366/146 |

FOREIGN PATENT DOCUMENTS

| | | | |
|---|---|---|---|
| 1208928 | 10/1970 | United Kingdom | 392/362 |
| 2175815 | 3/1988 | United Kingdom . | |
| 2218473 | 11/1989 | United Kingdom . | |

*Primary Examiner*—Edward K. Look
*Assistant Examiner*—Christopher M. Verdier
*Attorney, Agent, or Firm*—Beveridge, DeGrandi & Weilacher

[57] ABSTRACT

A heated rotor is provided to heat and circulate a substance comprising a shaft and at least one electrically heated rotor member supported on the shaft. The rotor member comprises an outer electrically conductive casing and at least one inner electrical conductor, electrically insulated from the casing. The or each inner conductor is electrically connected to the outer electrically conductive casing at an unsupported extremity of the rotor member. The shaft provides separate electrical connections to the or each inner conductor and the casing to enable an electric heating current to flow in the inner conductor between the or each unsupported blade extremity and the shaft.

17 Claims, 5 Drawing Sheets

ROTOR WITH INTERNAL ELECTRICAL HEATING ELEMENT

This invention relates to heated rotors which heat and circulate a substance.

In many circumstances it is desirable to simultaneously heat and circulate substances. Heating of a substance whilst mixing has commonly been done in a vessel wherein the vessel walls are heated and the substance mixed by using a propellor type paddle.

However, this technique has drawbacks in that the boundary layer of the substance next to the vessel walls is not moved and hence this prevents heat transfer to the bulk of the substance. This leads to localised inhomogeneous heating of the substance.

In GB 2175815 it proposed to alleviate this problem by forming the mixer blade paddle as an electrical heating element. In this apparatus the heating current is inductively passed to the shaft of the mixer and from there to the heating element of the paddle. The heating current is passed through the paddle 1 in a manner indicated in FIG. 1 of the drawings.

However, in this arrangement adjacent parts of the paddle are at differing electric potentials. Hence, electrochemically enhanced corrosion of the stainless steel paddle is likely, along with possible electrolysis of the substance being mixed.

According to the present invention a heated rotor for heating and circulating a substance comprises a shaft and at least one rotor member supported on said shaft; said rotor member comprising an outer electrically conductive casing and at least one inner electrical conductor electrically insulated from said outer electrically conductive casing, the or each said inner electrical conductor being electrically connected to said outer electrically conductive casing at an unsupported extremity of said rotor member; said shaft providing separate electrical connections to at least two of the or each said inner electrical conductor and said outer electrically conductive casing to enable an electric heating current to flow in said inner electric conductor between the or each said unsupported extremity and said shaft.

Preferably, said electrical conductor is electrically insulated from said casing by mica.

In order to ensure direct heating of the substance, the electrical conductor may have a low resistance with respect to the electrically conductive casing.

In an embodiment for mixing and heating substances, the rotor member comprises a blade having inner electrical conductor, said blade being adapted to enable electric current to flow in said outer electrically conductive casing between said unsupported extremity and said shaft. In such an arrangement the heated rotor preferably includes three blades equiangularly arranged about said shaft, wherein said shaft provides a separate electrical connection between the inner electric conductor of each said blade and a single respective phase of a three phase electricity supply.

In the heated mixer, preferably the face of said blade is broader at said unsupported extremity than at said shaft. In such an arrangement a thin layer of high electrical conductivity material may be provided on the inner surface of said electrically conductive casing at a position near said shaft in order to reduce the temperature near the shaft.

The electrically conductive casing may be made of two sheets of stainless steel seam welded about three sides of the periphery thereof and the electrical conductor may be constructed from brass or copper. Alternatively said electrically conductive casing may be made of a planar sheet of stainless steel forming the face of said rotor member and a stainless steel conduit member welded to said planar sheet along the axis of said rotor member to encase said inner electrical conductor. Electrical connection between the two can then be provided either by brazing them together or by providing a stainless steel spacer to one side of which said electrical conductor is brazed and to the other side of the periphery of said electrically conductive sheath at said unsupported extremity of said blade is welded to provide the electrical connection between said electrical conductor and said electrically conductive casing.

In an embodiment for circulating or pumping and heating substances, the rotor member comprises at least three inner electric conductors substantially equiangularly arranged about said shaft and said rotor member is arranged to enable electric current to flow in said outer electrically conductive casing between said unsupported extremities. In such an arrangement the rotor member preferably comprises three inner electric conductors and said shaft provides a separate electric communication between each inner electric conductor and a single respective phase of a three phase electricity supply.

Examples of the invention will now be described with reference to the accompanying drawings, in which:

FIG. 1 illustrates a heated mixer blade of the prior art;

FIG. 2*a* diagrammatically illustrates a planar section through a blade of a heated rotor according to one embodiment of the present invention;

FIG. 2*b* diagrammatically illustrates a planar section through a blade of a heated rotor according to another embodiment of the present invention;

Figure 8:
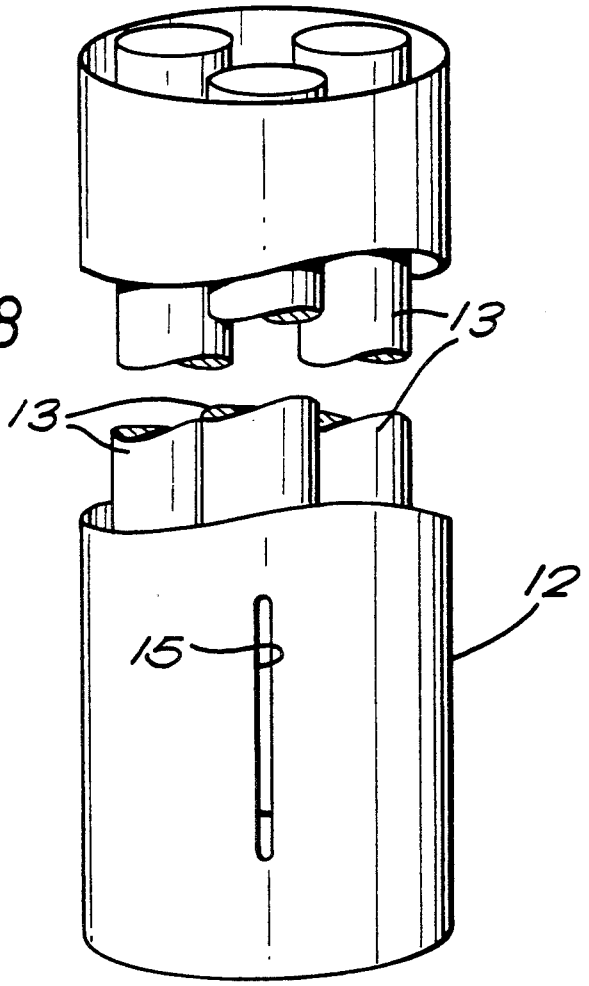
Figure 9:
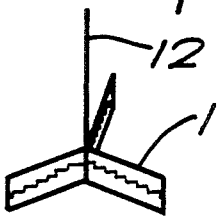
Figure 10:
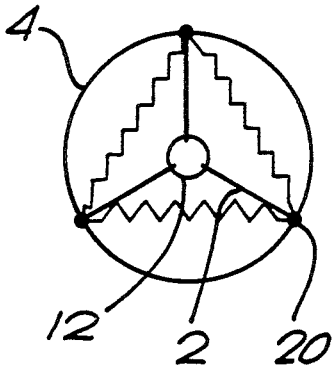
Figure 11:
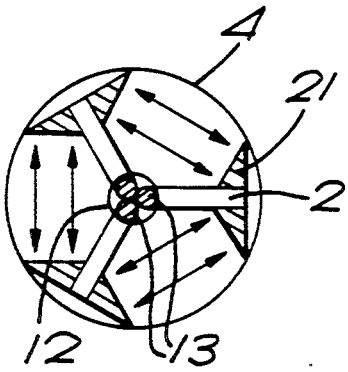
Figure 12:
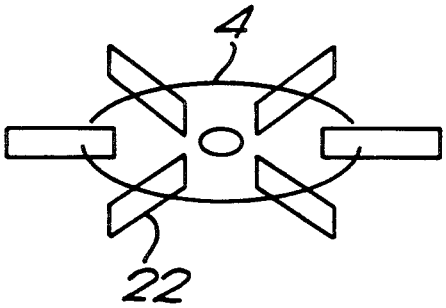
Figure 13:
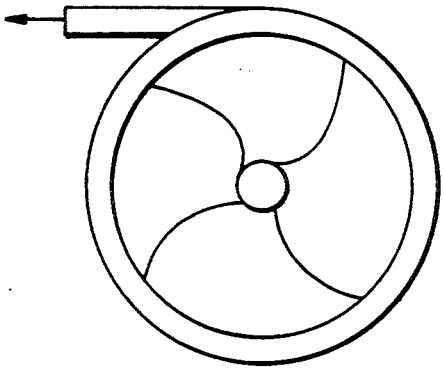

FIG. 8 diagrammatically illustrates a heated rotor with three blades mounted on the shaft;

FIG. 9 illustrates the electrical connections within the shaft;

FIG. 10 diagrammatically illustrates the principle of another embodiment of the present invention;

FIG. 11 illustrates a section across the shaft through the heated rotor according to one embodiment of the present invention;

FIG. 12 illustrates the attachment of blades to the rotor member;

FIG. 13 illustrates the case of a heated rotor according to one embodiment of the present invention in a centrifugal pump.

One aspect of the invention will now be described in detail with reference to FIGS. 2 to 9.

Figure 2A:
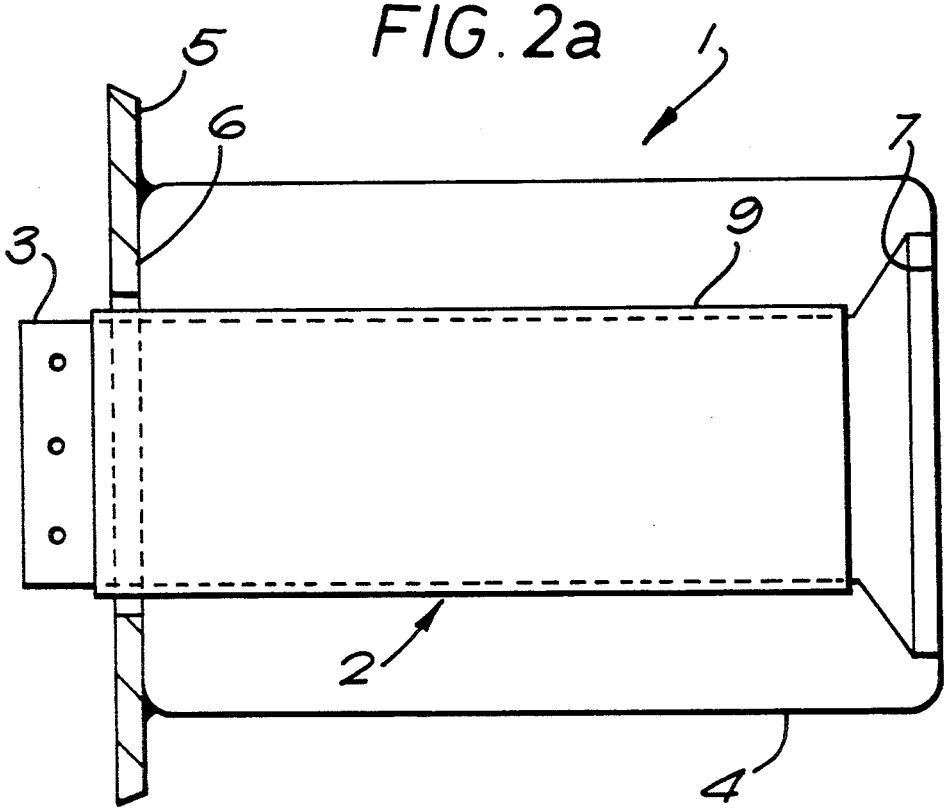

FIG. 2*a* illustrates a planar section through a blade of a heated rotor. The blade 1 comprises an electrical conductor 2 in the form of a strip of conductive material such as brass or copper. At one end of the conductor 2 is a connector in the form of a connecting block 3 provided to enable the blade 1 to be electrically connected to the electrical connections or bus bars within the shaft when the blade 1 is attached thereto.

An electrically conductive casing 4 encloses the conductor 2, except at a face of a flange 5 where the conductor 2 is exposed and the connecting block 3 provided. The casing 4 is made of a corrosion resistant material, stainless steel and therefore the flange 5 is welded thereto at weld-point 6. The casing 4 is made by seam welding two stainless steel plates about their periphery. Therefore, the inner conductor 2 is totally enclosed within the casing 4 and does not contact the substance being heated.

At the enclosed end 7 of the casing 4 which is the unsupported extremity of the blade, the conductor 2 is electrically connected to the casing 4. This can be provided by brazing the copper or brass element 2 to the casing 4.

Figure 2B:
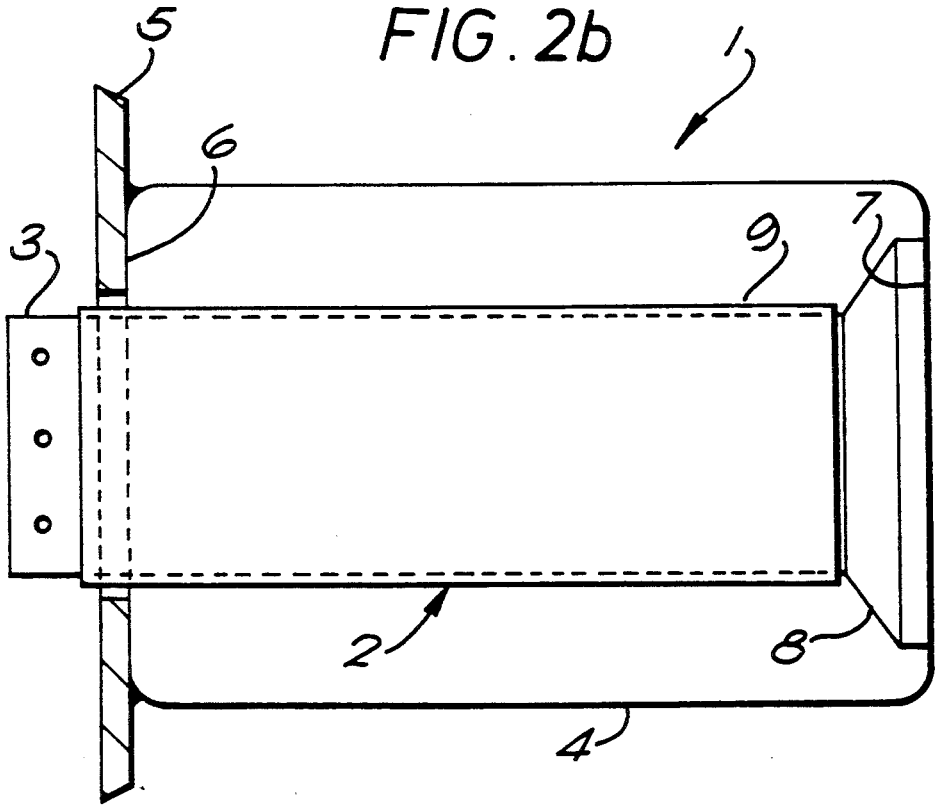

FIG. 2*b* illustrates an alternative arrangement in which a stainless steel spacer 8 is provided at the end of the conductor 2 and brazed thereto. The spacer 8 is then welded to the enclosed end of the casing 4. This arrangement simplifies the construction of the blade 1 since the brazing and welding joints are separated. Using this constructional arrangement, the seams of the casing 4 can be more accurately welded.

Along the length of the conductor 2, separating the conductor 2 from the casing 4 is an electrically insulating material, mica 9. This is provided to ensure that the current path is from the conductive block 3 to the flange 5 through the closed end 7 of the casing 4, and that no electrical shorting takes place.

Figure 1:
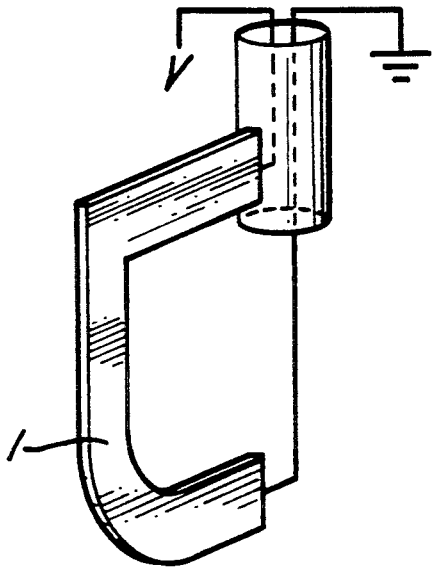
FIG. 1 Prior Art
Figure 3:
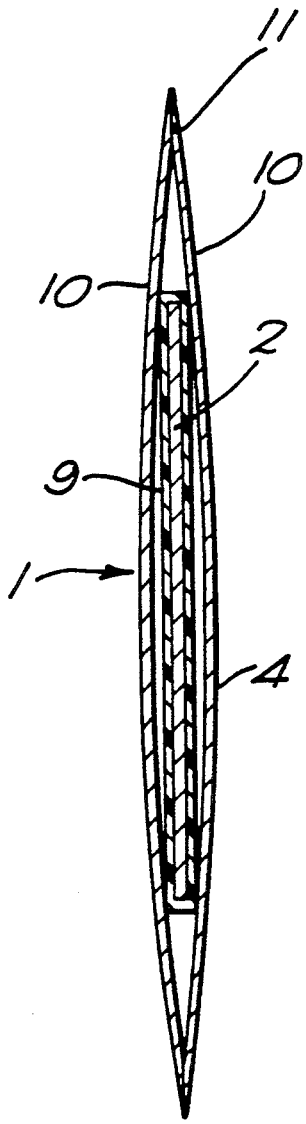
FIG. 3 illustrates a cross section through the embodiment of FIG. 2.

FIG. 3 illustrates in cross section the construction of the blade 1. The mica 9 encloses the conductor 2 to insulate it from the stainless steel sheets 10 of the casing 4. This figure shows that the stainless steel sheets 10 have to be bent towards one another in order for the seam weld 11 to be formed.

Figure 4:
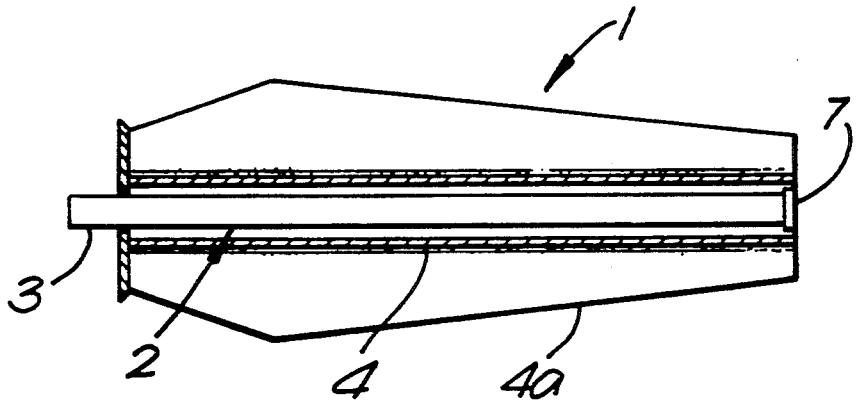
FIG. 4 illustrates a planar section through an alternative structure of a heated rotor blade according to one embodiment of the present invention.
Figure 5:
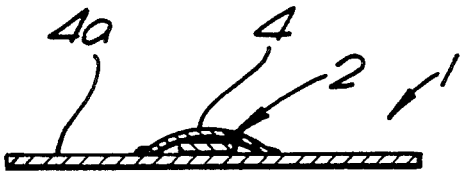
FIG. 5 illustrates a cross-section through the blade of FIG. 4.

FIG. 4 and 5 illustrate an alternative arrangement wherein only one part of the casing 4*a* forms the blade face whilst the other part 4 covers the inner conductor along its length. The two parts 4 and 4*a* are seam welded together along the length of the blade to form a seal around the inner conductor 2.

In this arrangement only one part of the blade 4 need be bent around the inner conductor 2. This part 4 also acts as a strengthening structure for the blade.

Figure 6:
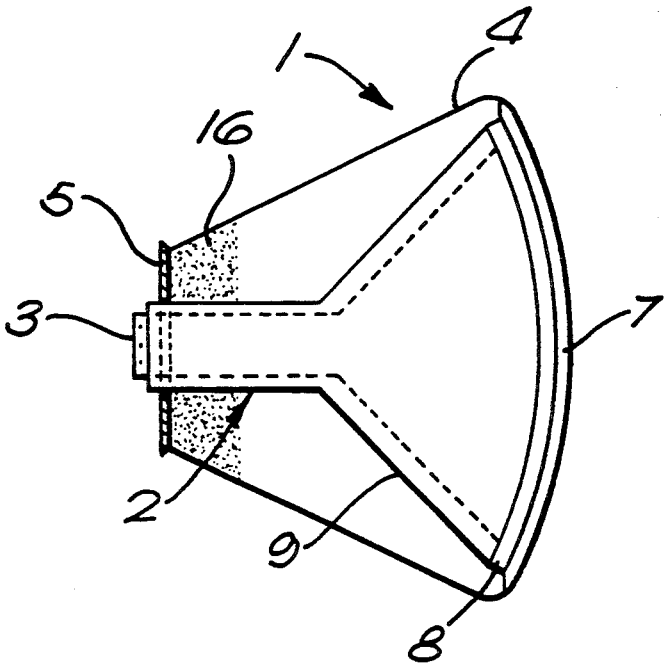
FIG. 6 illustrates a planar section through a tapered blade of a heated rotor according to a further embodiment of the present invention.

FIG. 6 illustrates an embodiment of the invention in which the face of the blade 1 tapers in near the connection block 3. If this shape of blade 1 is used then the resistance of the casing 4 across the blade 1 increases near the connecting block 3. Therefore this area is likely to get hotter. Further, because this area is nearer the axis of rotation of the blade 1 then the flow of the substance being heated is less over this area. Therefore, fouling is likely at this point unless the resistance can be reduced. This is achieved by a thin layer of copper foil 16 bonded to the inner surface of the casing 4 at these near axis portions.

In fact, the inclusion of the copper foil 16 at any place on the inner surface of the casing 4 allows the temperature profile across the blade to be varied. Similarly, varying the thickness of the casing 4 will change the blade temperature profile.

Figure 7:
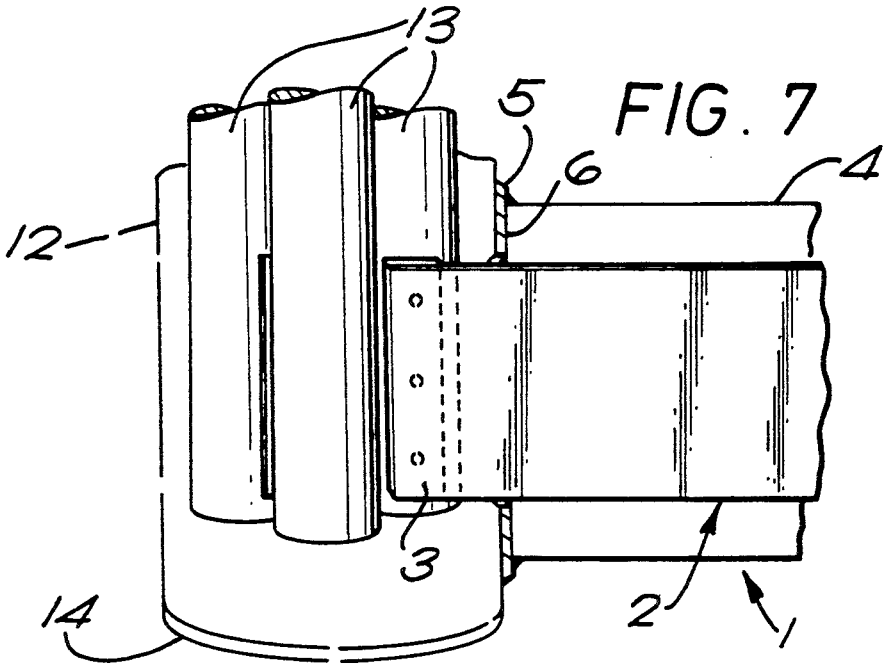
FIG. 7 illustrates the blade of a heated rotor mounted on the shaft according to one embodiment of the present invention.

In FIG. 7, the method of afixing the blade 1 to the shaft 12 is illustrated. The connecting block 3 is connected to a bus bar 13 within the shaft 12; the conductor 2 projecting through the shaft wall to enable this. The flange 5 of the blade 1 is affixed to the shaft wall by welding or the like. The shaft 12 is constructed from the corrosion resistant material stainless steel, and is provided with a baseplate 14 to seal the shaft 12. Three bus bars 13 are shown, each of which can be provided with a single phase of a three phase supply, and a blade 1 separately attached to each. Thereby, the shaft 12 supports three blades 1 each being supplied by a single phase of a three phase supply. The wall of the shaft 12 then acts as the neutral connector connected to the flanges 5 of the blades (FIG. 8). Thus the three phases are joined at a star connection.

FIG. 9 illustrates the shaft 12 with no blades attached. In this diagram the slot 15 to accommodate the connector block 3 of the conductor 2 is clearly shown.

In use, the blade 1 has a heating current passed from the connecting block 3 to the flange 5 and hence the shaft 12, through the closed end 7 of the casing 4. Since the casing 4 is constructed from material of a higher electrical resistance than the conductor 2, the faces of the blade become hot and heat the substance.

This aspect of the invention is particularly applicable when a substance is to be heated and mixed. This construction of a mixer blade is advantageous over prior art designs in that the potential drop is along the surface of the the blade and not across any gaps in the blade and hence electrochemical enhanced corrosion should be greatly reduced. Further, since there is no gap in the blade, cleaning is simplified. This design also has the advantage that a larger level of flexibility in blade design is obtained with the possibility of mimicking the external appearance of conventional mixer blades.

A further aspect of the invention will now be described with reference to FIGS. 10 to 13.

In this aspect of the invention shown diagrammatically in FIG. 10, at least three inner conductors 2 connect the bus bars 13 in the shaft 14 to points 20 around the circumference of the casing 4 and current is passed between these points 20 through the casing 4. The current path is indicated in this diagram by a jagged line which is a high resistance path. Therefore, the casing 4 in between the points 20 is heated ohmically, thus heating the substance adjacent to it. The most convenient arrangement three conductors 2 are used and each of these is connected via the bus bars 13 in the shaft 14 to a respective phase of a three phase supply. Thus the three phases are joined at a delta point.

FIG. 11 is a more detailed illustration of one construction giving the arrangement of FIG. 10. In this configuration the casing 4 is in the form of a disk, constructed from two stainless steel sheets welded about their circumference. The inner conductors 2 are provided with high conductivity spacers 21 at their extremities, comprising copper triangular sheets. These are added as backing to the inner surfaces of the casing 4, and provide equipotentials between corresponding radial points of spacers 21 of adjacent inner conductors 2. In other words, the current path length between equivalent radial points on adjacent spacers 21 is constant. This allows for uniform heating of the areas between the spacers 21. However this would cause the areas of the casing 4 with copper backing not to be heated. This can be avoided with careful design so that some heating of these areas takes place, by using thin copper so that radial equipotential is not quite achieved and some current flows through these areas.

The casing 4 need not be a disk, but can be a ring shape with spokes covering the conductors 2. This arrangement still allows the current to be conducted between the points 20 on the circumference.

FIG. 12 digrammatically illustrates one type of attachment of blades 22 to the casing 4, where the casing is shaped either as a disk or a ring forming an impeller. The blades 22 are not directly heated. Any heat they receive is conducted from the areas on the casing 4 that are being heated. Generally therefore the heating of the substance being circulated is done by the areas on the casing 4.

This aspect of the invention may be used where the heating and mixing of a substance is required. However, it is most appropriate for use in turbine mixer blades such as Rushon Turbine Impellers, or for impellers for centrifugal pumps such as that shown in FIG. 13. Thus a substance can be heated as it is pumped.

Thus the invention is useful for any application where a substance is to be circulated and heating of the rotor is useful to for instance prevent fouling of components. Further, the shape of the rotor can be made to correspond to conventional unheated rotors and therefore they can replace conventional rotors and confer on the apparatus in which it is incorporated the advantage of also being able to heat the substance.

We claim:

1. A heated rotor for heating and circulating a substance comprising a shaft and at least one rotor member supported on said shaft; said rotor member comprising an outer electrically conductive casing and at least one inner electrical conductor electrically insulated from said outer electrically conductive casing, the or each said inner electrical conductor being electrically connected to said outer electrically conductive casing at an unsupported extremity of said rotor member; said shaft providing separate electrical connections to at least two of the or each said inner electrical conductor and said outer electrically conductive casing to enable an electric heating current to flow in said inner electric conductor between the or each said unsupported extremity and said shaft.

2. A heated rotor as claimed in claim 1 wherein the or each said inner electrical conductor is electrically insulated from said outer electrically conductive casing by mica.

3. A heated rotor as claimed in claim 1 wherein said inner electrical conductor has a low resistance with respect to said outer electrically conductive casing.

4. A heated rotor as claimed in claim 1 wherein said rotor member comprises a blade having said inner electrical conductor, said blade being adapted to enable electric current to flow in said outer electrically conductive casing between said unsupported extremity and said shaft.

5. A heated rotor as claimed in claim 4 including three blades equiangularly arranged about said shaft, wherein said shaft provides a separate electrical connection between the inner electric conductor of each said blade and a single respective phase of a three phase electricity supply.

6. A heated rotor as claimed in claim 4, wherein the face of said blade is broader at said unsupported extremity than at said shaft.

7. A heated rotor as claimed in claim 6 wherein a thin layer of a high electrical conductivity material is provided on the inner surface of said outer electrically conductive casing at a portion adjacent or in the vicinity of said shaft.

8. A heated rotor as claimed in claim 5, wherein said electrically conductive casing comprises two sheets of stainless steel, seam welded about three sides of the periphery thereof.

9. A heated rotor as claimed in claim 5 wherein said electrically conductive casing comprises a planar sheet of stainless steel forming the face of said rotor member and a stainless steel conduit member welded to said planar sheet along the axis of said rotor member to encase said inner electrical conductor.

10. A heated rotor as claimed in claim 5, wherein said inner electrical conductor is constructed from brass or copper.

11. A heated rotor as claimed in claim 8 wherein the electrical connection between said electrically conductive casing and said inner electrical conductor is provided by brazing.

12. A heated rotor as claimed in claim 8 wherein a stainless steel spacer is provided, to one side of which said inner electrical conductor is brazed and to the other side of which the periphery of said outer electrically conductive casing at said unsupported extremity of said blade is welded to provide the electrical connection between said inner electrical conductor and said outer electrically conductive casing.

13. A heated rotor as claimed in claim 1 wherein said rotor member comprises at least three inner electric conductors substantially equiangularly arranged about said shaft and said rotor member is arranged to enable electric current to flow in said outer electrically conductive casing between said unsupported extremities.

14. A heated rotor as claimed in claim 13, wherein said rotor member comprises three inner electric conductors and said shaft provides a separate electric communication between each inner electric conductor and a single respective phase of a three phase electricity supply.

15. A heated rotor as claimed in claim 13 wherein said rotor member is a hollow disk shaped member with blades perpendicularly attached thereto, and axially supported by said shaft.

16. A rotor member as claimed in claim 15, wherein the outer electrically conductive casing is formed from two disks of stainless steel, seam welded about their circumference.

17. A rotor member as claimed in claim 13 wherein said inner electrical conductors have high conductivity spacers at the unsupported extremities thereof adapted to provide a substantially constant current path length between said inner electrical conductors across the radius of the rotor.

* * * * *